US007322211B2

(12) United States Patent
McKenzie

(10) Patent No.: US 7,322,211 B2
(45) Date of Patent: Jan. 29, 2008

(54) RING

(76) Inventor: Clancy D. McKenzie, 905 Centennial Rd., Narberth, Penn Valley, PA (US) 19072

( * ) Notice: Subject to any disclaimer, the term of this patent is extended or adjusted under 35 U.S.C. 154(b) by 3 days.

(21) Appl. No.: 10/659,244

(22) Filed: Sep. 10, 2003

(65) Prior Publication Data

US 2005/0050919 A1 Mar. 10, 2005

(51) Int. Cl.
*A44C 9/00* (2006.01)
*A44C 5/00* (2006.01)

(52) U.S. Cl. ..... 63/15; 63/3

(58) Field of Classification Search ..... D11/26; 600/38–41; 128/885, 842
See application file for complete search history.

(56) References Cited

U.S. PATENT DOCUMENTS

D177,967 S * 6/1956 Edwards ..... D11/126
3,806,126 A * 4/1974 Gilbert ..... 273/253
4,042,244 A 8/1977 Kakovitch
4,240,858 A 12/1980 Lamlee
4,919,427 A 4/1990 Keidar et al.
5,324,037 A 6/1994 Greeson
6,364,614 B1 4/2002 Mnatsakanian
6,524,073 B2 2/2003 Mnatsakanian
6,595,519 B1 7/2003 McGoveran
6,723,044 B2 * 4/2004 Pulford et al. ..... 600/208

OTHER PUBLICATIONS

Bedazzle webpage, www.bedazzlejewelry.com/goldrings.html.*
Roman Intaglios and Cameos, www.ancienttouch.com/roman-intaglios-cameos.htm.*
The First "Scientific American" Book of Mathematical Puzzles and Games: "Hexaflexagons and Other Mathematical Diversions"-Martin Gardner (Excerpts-9 sheets).
"Infinity Bangle" advertisement in "The Atlantic Monthly" magazine-Nov. 2002 (2 sheets).

* cited by examiner

*Primary Examiner*—Jack W. Lavinder
(74) *Attorney, Agent, or Firm*—Leydig, Voit & Mayer, Ltd.

(57) ABSTRACT

A ring-like article of manufacture capable of being worn as jewelry such as a ring on a human finger for adornment, having a triangular cross section throughout its circumference, wherein the sides of the triangular cross section are formed by a single continuous, endless surface, and the vertexes of the triangular cross section are formed by a single continuous, endless ridge that preferably acts as an internal thread that is capable of being used to screw or unscrew the ring when worn on the finger.

18 Claims, 7 Drawing Sheets

RING

BACKGROUND OF THE INVENTION

1. Field of the Invention

The invention relates to a ring construction having unique properties that invite analyses by an observer. The ring can be used, for instance, as jewelry for human adornment, such as a finger ring or a wrist or neck bracelet, or can be formed into an exhibit, large or small. It is a form of a puzzle.

2. The Prior Art

U.S. Pat. No. 4,042,244 discloses a Moebius ring formed from an elongated band of two sides. The Moebius phenomena, wherein a band with two sides is given a twist throughout the length of its circumference, is used to form the ring in the '244 patent.

Other prior art rings using the Moebius phenomena are known.

The Moebius phenomena is also used in numerous puzzles.

SUMMARY OF THE PRESENT INVENTION

The ring of the present invention departs from the concept of a flat band, as in the Moebius phenomena in the prior art, and deals with a triangular cross section that, when formed into a ring, has a single continuous surface, and a single continuous ridge, that form the triangular cross section. Whereas the Moebius ring has a 180° twist of the cross section throughout the length of its circumference, the present invention requires either a 120°, or a multiple of 120°, twist, that is not 360° or a multiple of 360°, throughout one complete circumferential travel. A 360° twist, or a multiple thereof, does not work.

The ring of the present invention has a triangular cross section at any point along its circumference. The triangular cross section has three sides and three vertexes. Each of the vertexes forms a ridge.

By virtue of the ring's construction, a single continuous, endless surface extending longitudinally along the circumference of the ring forms all three sides of a triangular cross section of the ring, and a single continuous ridge forms all three vertexes of a triangular cross section of the ring. The continuous, endless ridge and the continuous, endless surface, that form a ring with a triangular cross section at any point on its circumference, is achieved by giving, to the cross section of the ring, a twist or rotation of 120°, or multiples thereof, that is not 360° or a multiple of 360°, about the circumferential axis, through the length of the travel of one circumference of the ring.

BRIEF DESCRIPTION OF THE DRAWINGS

FIG. 28 is a perspective view of a straight length having a triangular cross section capable of being formed into the ring of FIG. 1, having a length equal to the circumference of the ring of FIG. 1.

FIG. 29 is a view similar to FIG. 28 showing the length twisted 120° about its longitudinal axis before being formed into a ring.

FIG. 30 shows the straight length, as shown twisted or rotated in FIG. 29, formed into a circumference, with the ends of the length about to be joined, in their rotated condition.

DESCRIPTION OF THE PREFERRED EMBODIMENT

Figure 1:
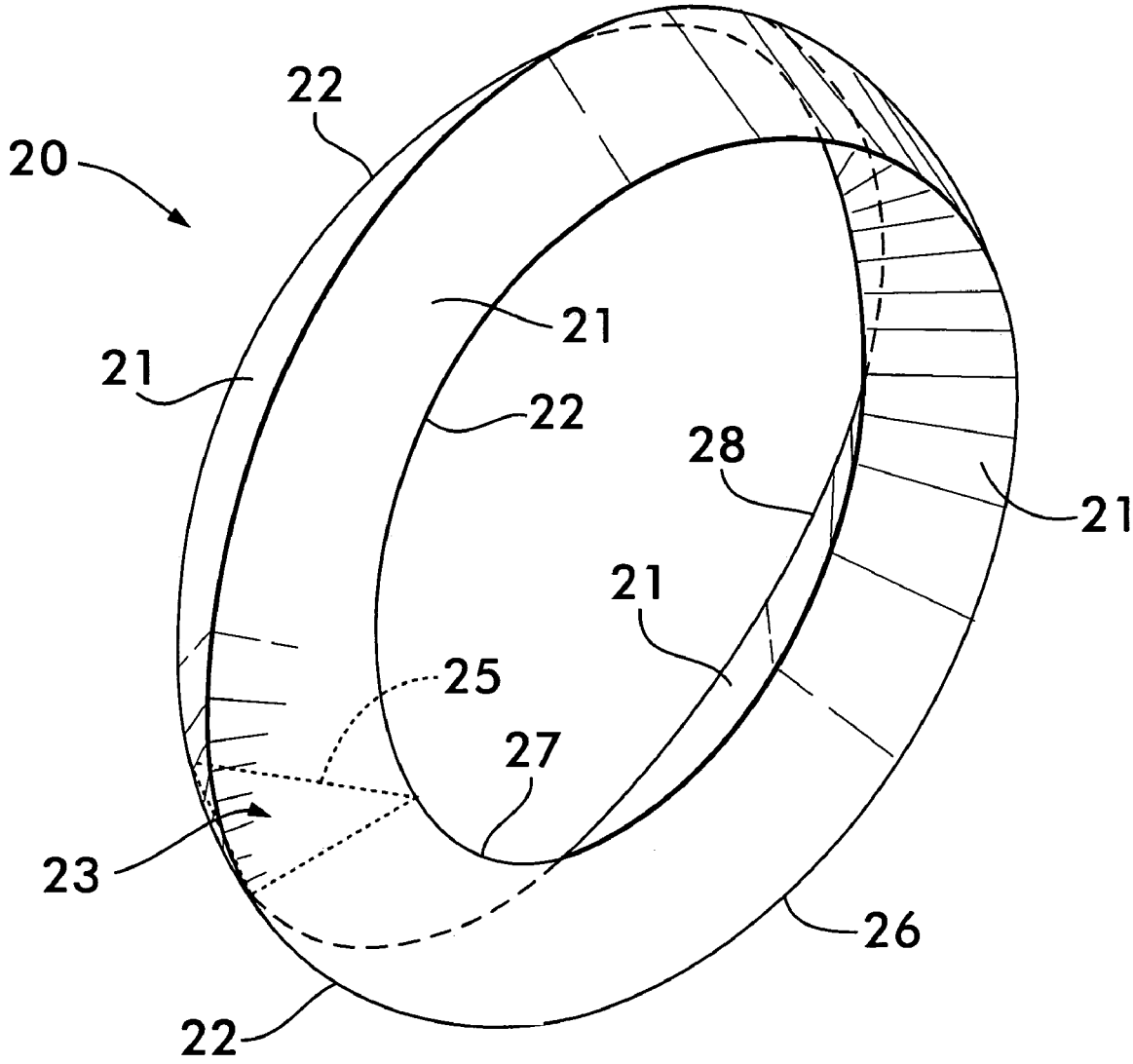
FIG. 1 is a perspective view of the ring of the invention, with a triangular cross section shown in dotted lines, and the ridge, where hidden, shown in broken lines.
Figure 2:
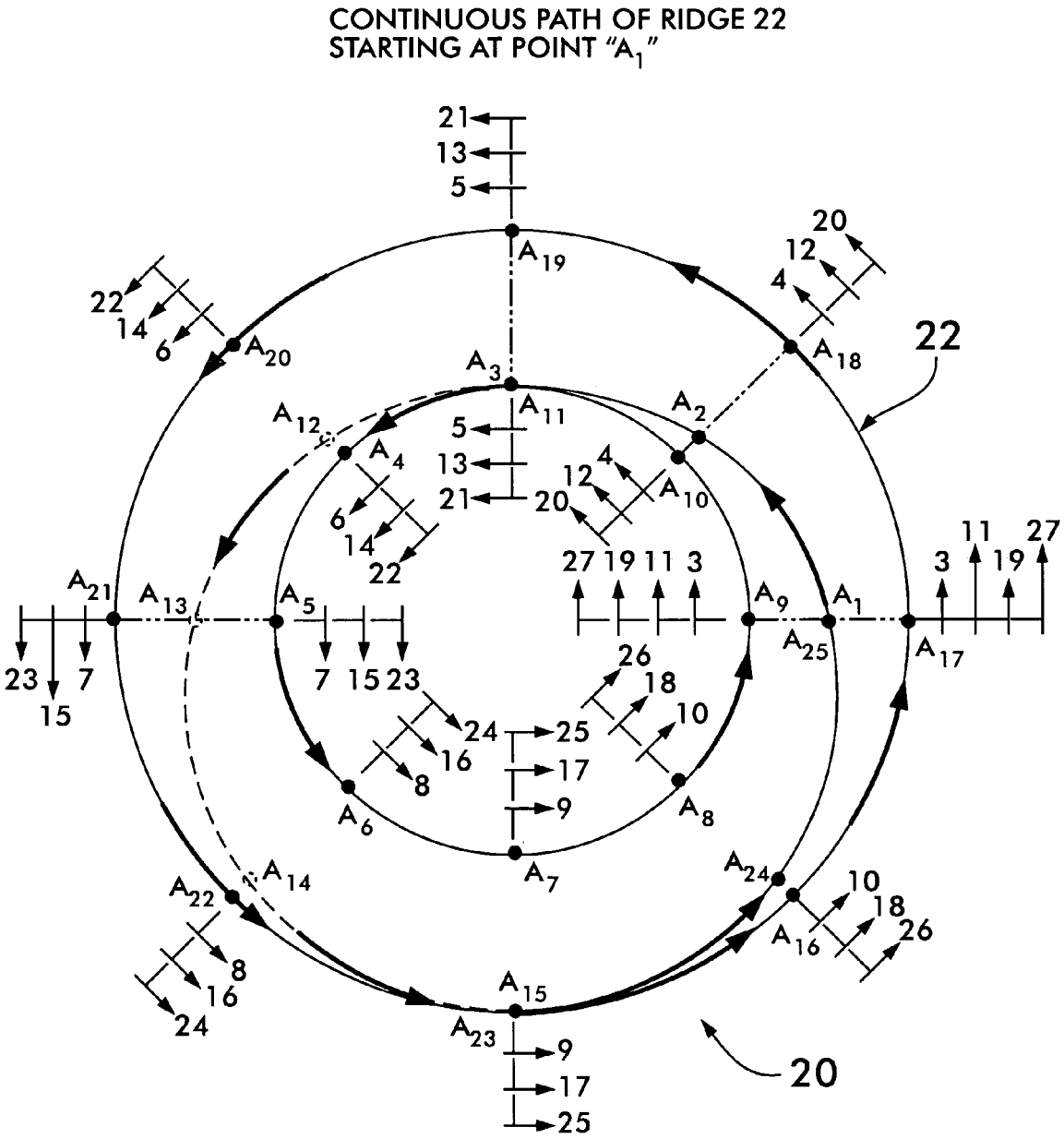
FIG. 2 is a front view of the ring of the invention showing the continuous path of the ridge starting at point "A".

In FIG. 1, there is shown the ring 20 of the invention having a continuous, endless surface 21 and a continuous, endless ridge 22.

The ring 20, at any point along its circumference, has a triangular cross section 23, as shown, for instance, by dotted lines at 25 in FIG. 1.

An examination of ridge 22 in FIG. 1 will reveal that what appear to be three distinct ridges 26, 27, 28, at the vertexes of the triangular cross section 23 along the ring 20 is in reality one continuous, endless ridge 22.

In like manner, the three sides 30, 31, 32 that form the triangular cross section 23 of the ring 20, appear to be formed by three distinct different surfaces, but in reality the sides 30, 31, 32, are formed by one continuous endless surface 21.

To explain the phenomena of one continuous, endless ridge 22, and one continuous, endless surface 21, reference is made particularly to FIGS. 2 through 27 inclusive.

Figure 3:
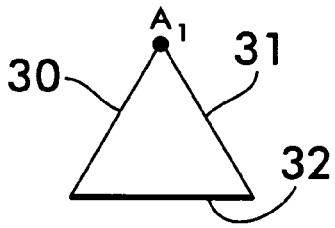
FIG. 3 is a cross sectional view taken on the line 3-3 of FIG. 2.
Figure 4:
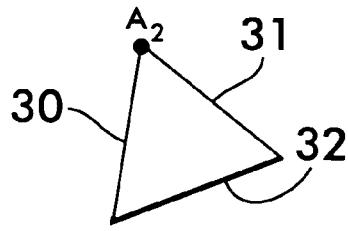
FIG. 4 is a cross sectional view taken on the line 4-4 of FIG. 2.
Figure 5:
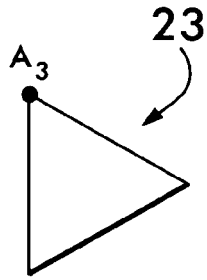
FIG. 5 is a cross sectional view taken on the line 5-5 of FIG. 2.
Figure 6:
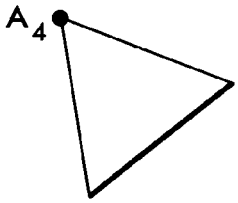
FIG. 6 is a cross sectional view taken on the line 6-6 of FIG. 2.
Figure 7:
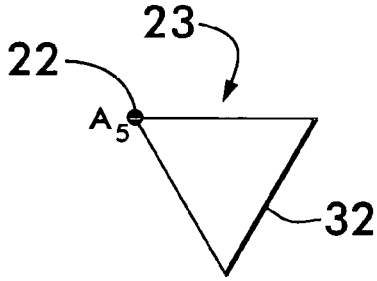
FIG. 7 is a cross sectional view taken on the line 7-7 of FIG. 2.
Figure 8:
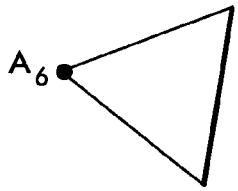
FIG. 8 is a cross sectional view taken on the line 8-8 of FIG. 2.
Figure 9:
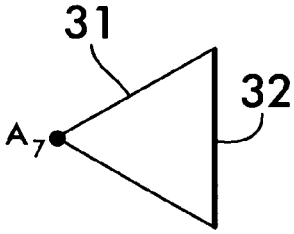
FIG. 9 is a cross sectional view taken on the line 9-9 of FIG. 2.
Figure 10:
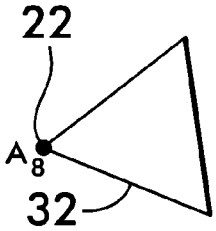
FIG. 10 is a cross sectional view taken on the line 10-10 of FIG. 2.
Figure 11:
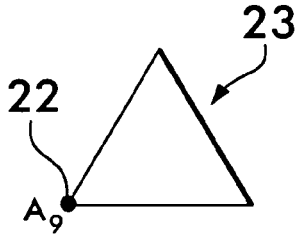
FIG. 11 is a cross sectional view taken on the line 11-11 of FIG. 2.
Figure 12:
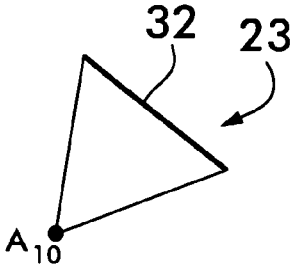
FIG. 12 is a cross sectional view taken on the line 12-12 of FIG. 2.
Figure 13:
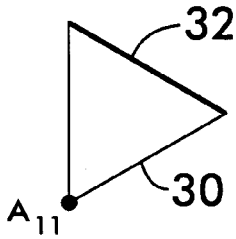
FIG. 13 is a cross sectional view taken on the line 13-13 of FIG. 2.
Figure 14:
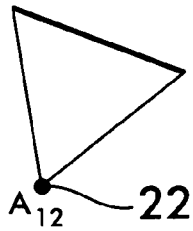
FIG. 14 is a cross sectional view taken on the line 14-14 of FIG. 2.
Figure 15:
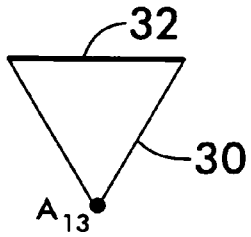
FIG. 15 is a cross sectional view taken on the line 15-15 of FIG. 2.
Figure 16:
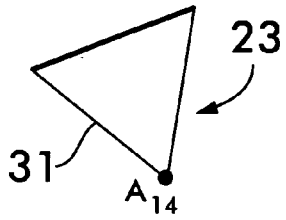
FIG. 16 is a cross sectional view taken on the line 16-16 of FIG. 2.
Figure 17:
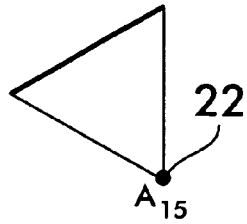
FIG. 17 is a cross sectional view taken on the line 17-17 of FIG. 2.
Figure 18:
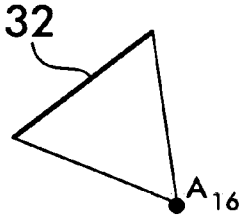
FIG. 18 is a cross sectional view taken on the line 18-18 of FIG. 2.
Figure 19:
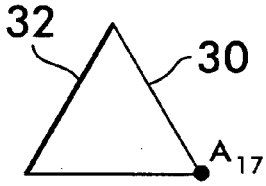
FIG. 19 is a cross sectional view taken on the line 19-19 of FIG. 2.
Figure 20:
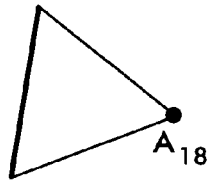
FIG. 20 is a cross sectional view taken on the line 20-20 of FIG. 2.
Figure 21:
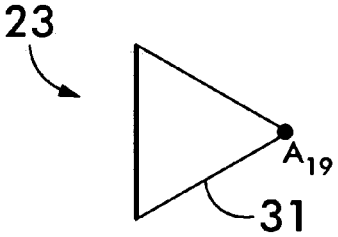
FIG. 21 is a cross sectional view taken on the line 21-21 of FIG. 2.
Figure 22:
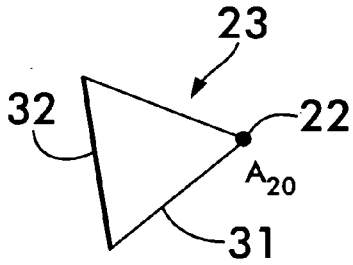
FIG. 22 is a cross sectional view taken on the line 22-22 of FIG. 2.
Figure 23:
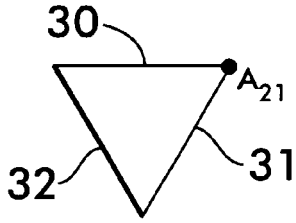
FIG. 23 is a cross sectional view taken on the line 23-23 of FIG. 2.
Figure 24:
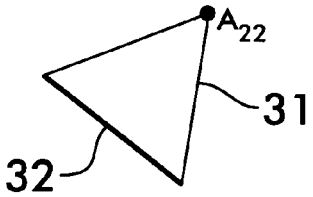
FIG. 24 is a cross sectional view taken on the line 24-24 of FIG. 2.
Figure 25:
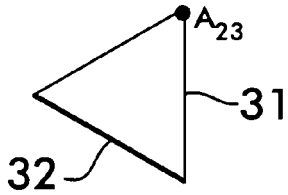
FIG. 25 is a cross sectional view taken on the line 25-25 of FIG. 2.
Figure 26:
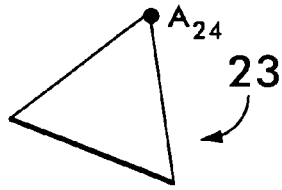
FIG. 26 is a cross sectional view taken on the line 26-26 of FIG. 2.
Figure 27:
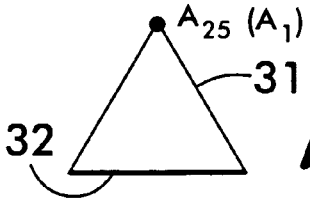
FIG. 27 is a cross sectional view taken on the line 27-27 of FIG. 2.

As seen in FIG. 3, the ridge 22 begins at position A1 and continues to travel around the ring 20 circumference three times, before it comes back to its original starting point.

As it travels about the circumference of the ring 20 three times, the triangular cross section 23 of the ring will twist, or rotate, about the circumferential axis of ring 20, once, as seen in FIGS. 3 through 27, to where the ridge at location A1 will coincide with location A25.

Figures 28, 29:
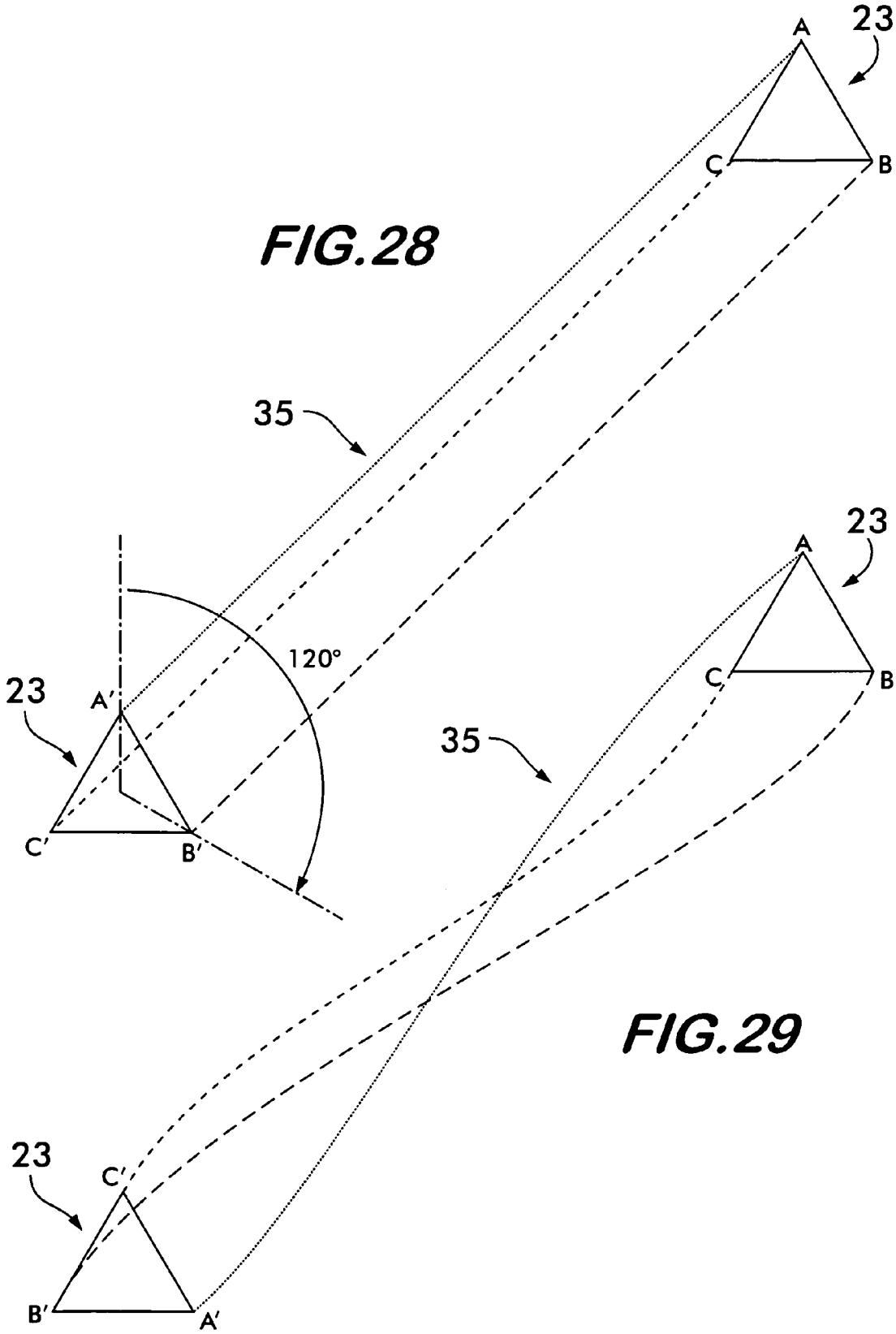
FIGS. 28 through 30 show a hypothetical construction of the ring to illustrate the principle of the ring.

FIGS. 28 and 29 illustrate the concept of the twist in a hypothetical construction of ring 20, to illustrate the twist which is present in the ring 20 of FIG. 1 itself. The twist, in FIGS. 28 and 29, for conceptual purposes, is shown in a length 35 of straight bar equal to the circumference of the ring 20.

As seen in FIG. 28, the length 35 of the bar is equal to the circumference of the ring 20. The length 35 of bar has a triangular cross section 23 with vertexes designated A, B, and C, at one end and A'B'C' at the other end. The length also has sides designated AB, BC, and CA at one end, and A'B', B'C', and C'A' at the other end. The bar is shown formed of a triangle which is equalateral throughout the bar length 35. However, as shown in FIGS. 31-34, the cross section 23, 100, 102, 104, 106 can vary throughout its length, providing it remains a triangle.

As seen in FIG. 29, the bar at A'B'C' remains fixed, whereas the bar at ABC is rotated 120° about the longitudinal axis of the length 35 of the bar. The length 35 of the bar may also be twisted or rotated multiples of 120°, but not twisted or rotated 360° or multiples of 360°, to form other embodiments of the invention. A twist of 360° or multiples thereof would create a ring with three separate surfaces and three separate ridges.

The twist may be uniform throughout the circumference of the ring, or the twist may occur at a non-uniform rate throughout the circumference of the ring 20. It is necessary, however, that the twist, or rotation, as explained above, does occur.

Figure 30:
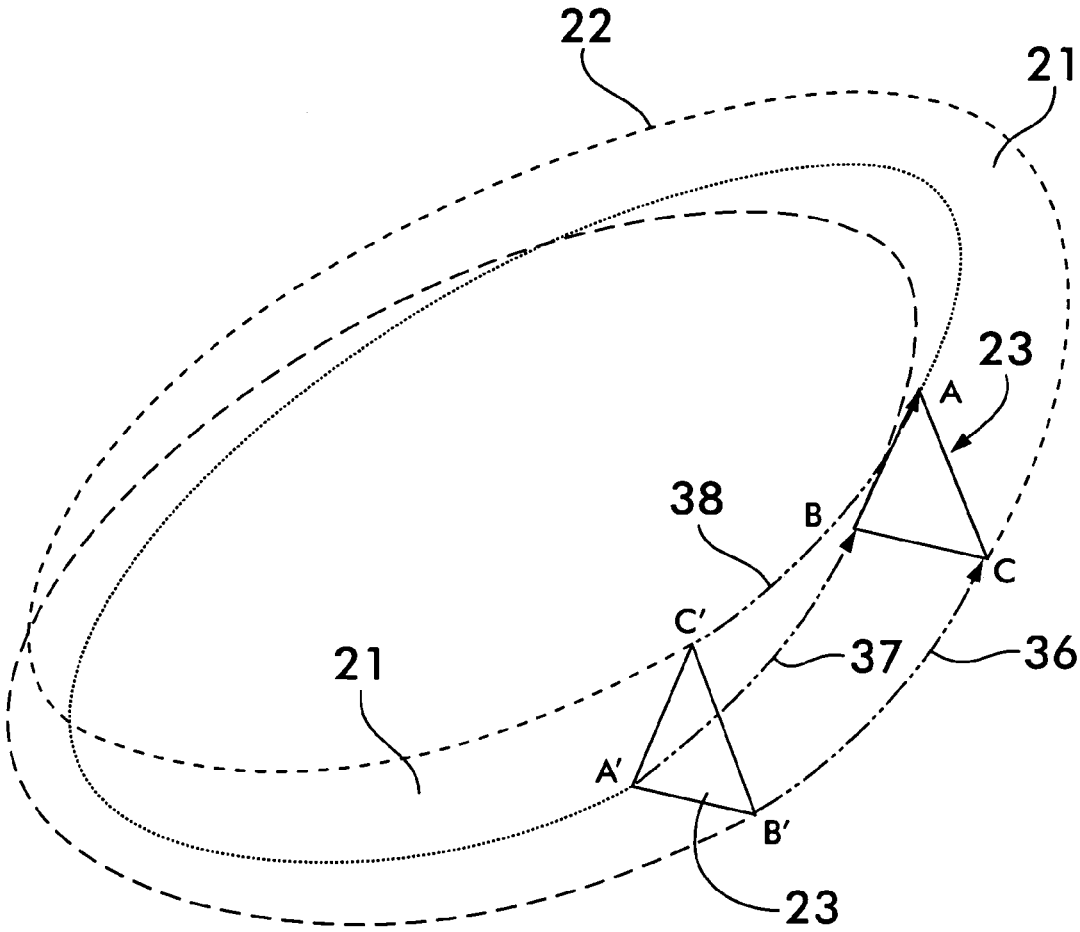
Figure 31:
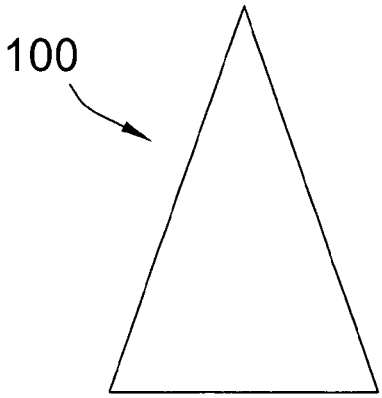
FIG. 31 is a cross sectional view showing the ring having a triangular cross section with two equal length sides.
Figure 32:
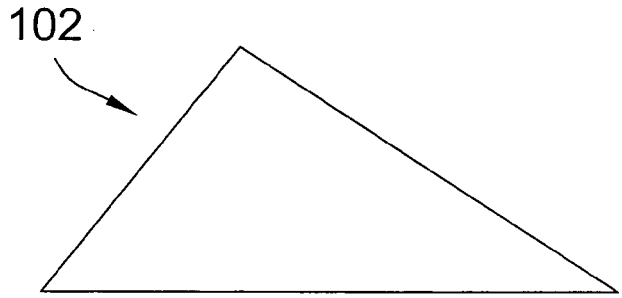
FIG. 32 is a cross sectional view showing the ring having a triangular cross section with unequal length sides.
Figure 33:
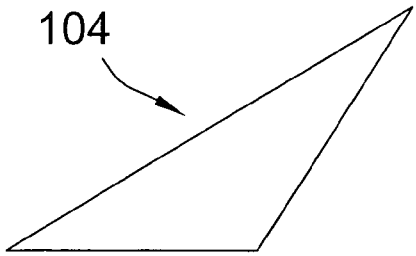
FIG. 33 is another cross sectional view showing the ring having a triangular cross section with unequal length sides.
Figure 34:
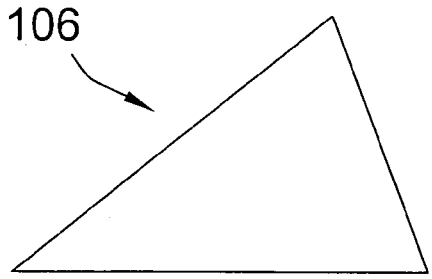
FIG. 34 is another cross sectional view showing the ring having a triangular cross section with unequal length sides.

To complete the illustration of a hypothetical construction of the ring 20 as shown in FIG. 1, the length 35 of the bar of FIG. 29 is bent circumferentially into the ring 20 of FIG. 1, as seen in FIG. 30. Side BC is joined to side A'B', side AB is joined to side A'C', and side CA is joined to side C'B'.

Vertex C' is joined to vertex A, vertex A' is joined to vertex B, and vertex B' joined to vertex C. In FIG. 30, the length 35 of the bar of FIG. 29 is not yet fully bent into the circumference of the ring 20 of FIG. 1.

In FIG. 30, a gap is shown between the cross sections 23 shown in solid lines to illustrate that the length 35 of the bar is to continue to be bent as shown by the arrowed lines 36, 37, and 38, to fully form the ring 20.

FIGS. 28, 29, and 30, merely illustrate the ring's characteristics when fully formed, and form no limitation on how the ring 20 is actually constructed, as, for instance, by well known prior art molding or forging techniques. The ring 20 may be formed of metal, wood, ceramic, plastic, or any other material that is or becomes solid.

Again, it should be understood that the actual manufacture of the ring 20 would be by prior art methods, such as a molding procedure, and that FIGS. 28, 29, and 30 merely are to illustrate the concept involved wherein a single continuous, endless ridge 22 forms all three vertexes of any cross section 23 of the ring 20, and a single continuous, endless surface 21 forms all three sides of any cross section 23 of the ring 20.

It is believed the ring 20 of the invention will create great interest in attempts to analyze the ring. Additionally, the continuous, endless ridge 22 with its travel about the circumference of the ring, can act as a thread that can be used to, in effect, screw or unscrew the ring 20 from the wearer, as, for instance, on or off a finger, or on or off a wrist.

What is claimed is:

1. A rigid ring-like article of manufacture capable of being worn as jewelry such as a ring on a finger or wrist of a human for adornment, having a circumferential axis; a triangular-shaped cross section at every cross-sectional location taken transverse to the circumferential axis; the cross section having three sides and three vertexes throughout the circumferential axis; the cross section being a 120° rotation of the triangular shape about the circumferential axis, through a distance of one complete circumference of the ring;

wherein a single continuous, endless surface forms all three sides of the triangular cross section, and a singular continuous, endless ridge forms each of the three vertexes where the sides of the triangular cross section meet and wherein the endless ridge is also on the interior surface of the ring and forms an interior internal thread capable of screwing or unscrewing the ring onto, or off of, the finger or wrist.

2. The rigid ring-like article of manufacture of claim 1 wherein the rotation of the cross sectional shape in one complete circumference about the circumferential axis is a multiple of 120° that is not 360° or a multiple of 360° or divisible integrally by 360°.

3. The rigid ring-like article of manufacture of claim 1 or claim 2, wherein the rotational position of the triangular cross section is uniform throughout the circumferential axis of the ring.

4. The rigid ring-like article of manufacture of claim 1 wherein the triangular-shaped cross section has sides of equal length.

5. The rigid ring-like article of manufacture as claimed in claim 1 wherein the ring-like article of manufacture is constructed of metal.

6. The rigid ring-like article of manufacture as claimed in claim 1 wherein the ring-like article of manufacture is constructed of wood.

7. The rigid ring-like article of manufacture as claimed in claim 1 wherein the ring-like article of manufacture is constructed of ceramic.

8. The rigid ring-like article of manufacture as claimed in claim 1 wherein the ring-like article of manufacture is constructed of rigid plastic.

9. The rigid ring-like article of manufacture as claimed in claim 1 wherein the ring-like article of manufacture cannot be rotated by hand about its circumferential axis.

10. A rigid article of manufacture capable of being worn as jewelry such as a ring on a finger or wrist of a human for adornment, the rigid article of manufacture having a substantially ring-like shape and a circumferential axis; a triangular-shaped cross section at every cross-sectional location taken transverse to the circumferential axis; each cross section having three sides and three vertexes; at least one of the cross sections having sides of equal length; each of the cross sections in combination forming a single continuous side and a single continuous ridge; the ridge undergoing a displacement by an angle about the circumferential axis that is equal to 120° or a multiple of 120° but not 360° or a multiple of 360° or divisible integrally by 360° through a single traversal of the substantially ring-like shape;

wherein the endless ridge is exposed at least partially to the interior of the rigid article of manufacture and forms an interior internal thread capable of assisting screwing or unscrewing the ring onto, or off of, the finger or wrist.

11. The rigid article of manufacture of claim 10 wherein at least one of the cross sections has exactly two sides of equal length.

12. The rigid article of manufacture of claim 10 wherein at least one of the cross sections has no sides of equal length.

13. The rigid article of manufacture of claim 10 wherein one of the cross sections has sides of equal length, and every other cross section has at least two sides of unequal length.

14. The rigid article of manufacture as claimed in claim 10 wherein the ring-like article of manufacture cannot be rotated by hand about its circumferential axis.

15. The rigid article of manufacture as claimed in claim 10 wherein at least one of the at least one cross sections having sides of equal length being located along the circumferential axis approximately half the distance along the circumferential axis around the substantially ring-like shape from another cross section having sides of equal length.

16. The rigid article of manufacture as claimed in claim 10 wherein the displacement of the ridge occurs at a uniform rate around the substantially ring-like shape.

17. The rigid article of manufacture as claimed in claim 10 wherein the displacement of the ridge occurs at a non-uniform rate around the substantially ring-like shape.

18. The rigid article of manufacture as claimed in claim 10 wherein the rigid article of manufacture is constructed of at least one of metal, wood, ceramic, and rigid plastic.

* * * * *